US010128099B1

(12) United States Patent
Schwartz et al.

(10) Patent No.: US 10,128,099 B1
(45) Date of Patent: Nov. 13, 2018

(54) SYSTEMS AND METHODS FOR REGULATING THE ION POPULATION IN AN ION TRAP FOR MS$^n$ SCANS

(71) Applicant: Thermo Finnigan LLC, San Jose, CA (US)

(72) Inventors: Jae C. Schwartz, Gilroy, CA (US); Linfan Li, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 15/655,453

(22) Filed: Jul. 20, 2017

(51) Int. Cl.
*H01J 49/42* (2006.01)
*H01J 49/06* (2006.01)

(52) U.S. Cl.
CPC ..... *H01J 49/424* (2013.01); *H01J 49/061* (2013.01); *H01J 49/4255* (2013.01); *H01J 49/4265* (2013.01)

(58) Field of Classification Search
CPC ..... H01J 49/061; H01J 49/42; H01J 49/424; H01J 49/4255; H01J 49/4265
See application file for complete search history.

(56) References Cited

U.S. PATENT DOCUMENTS 6,627,876 B2 * 9/2003 Hager ..... H01J 49/4225 250/282
6,884,996 B2 4/2005 Senko
6,987,261 B2 1/2006 Horning et al.
9,105,456 B2 8/2015 Jiang et al.
9,165,755 B2 * 10/2015 Remes ..... H01J 49/0036
9,190,251 B2 11/2015 Green et al.
9,324,547 B2 4/2016 Hauschild et al.
2004/0217272 A1 * 11/2004 Horning ..... H01J 49/4265 250/282
2010/0176291 A1 7/2010 Hager et al.
2012/0149125 A1 * 6/2012 Earley ..... H01J 49/0072 436/173
2014/0061460 A1 * 3/2014 Hauschild ..... H01J 49/38 250/283

OTHER PUBLICATIONS

Gao, "Space Charge Effects in Linear Quadrupole Ion Traps", Dissertation, The University of British Columbia, https://open.library.ubc.ca/c1Rcle/collections/ubctheses/24/items/1.0167667, 2015, 172 pages.

(Continued)

*Primary Examiner* — David E Smith
(74) *Attorney, Agent, or Firm* — David A. Schell

(57) ABSTRACT

A mass spectrometry apparatus includes an ion source, an ion trap and a mass spectrometer controller. The ion source is configured to generating ions. The ion trap is configured to trap ions within a RF field; eject unwanted ion while retaining target ions; and fragment target ions. The mass spectrometer controller is configured to determine an injection time for the ion trap based on a precursor ion flux and a product ion flux; fill the ion trap with ions from the ion source for an amount of time equal to the injection time; isolate target precursor ions in the ion trap; fragment the target precursor ions to generate product ions; and mass analyzing the product ions.

20 Claims, 17 Drawing Sheets

(56) References Cited

OTHER PUBLICATIONS

Gorshkov et al., "Calibration Function for the Orbitrap FTMS Accounting for the Space Charge Effect," J Am Soc Mass Spectrom 2010, 21, 1846-1851.

Kalli et al., "Evaluation and Optimization of Mass Spectrometric Settings During Data-dependent Acquisition Mode: Focus on LTQ-Orbitrap Mass Analyzers," J. Proteome Res., 2013, 12, pp. 3071-3086.

Page et al., "Automatic Gain Control in Mass Spectrometry Using a Jet Disrupter Electrode in an Electrodynamic Ion Funnel", J Am Soc Mass Spectrom 2005, 16, pp. 244-253.

* cited by examiner

SYSTEMS AND METHODS FOR REGULATING THE ION POPULATION IN AN ION TRAP FOR $MS^n$ SCANS

FIELD

The present disclosure generally relates to the field of mass spectrometry including systems and method for regulating the ion population in an ion trap for $MS^n$ scans.

INTRODUCTION

Mass spectrometry can be used to perform detailed analyses on samples. Furthermore, mass spectrometry can provide both qualitative (is compound X present in the sample) and quantitative (how much of compound X is present in the sample) data for a large number of compounds in a sample. These capabilities have been used for a wide variety of analyses, such as to test for drug use, determine pesticide residues in food, monitor water quality, and the like.

Space charge, the interacting forces between ions that are held/confined closely to each other, can degrade the performance of mass analyzers, particularly ion trapping devices. As the number of ions contained in the ion trap increase, the ions experience more interactions with the other surrounding ions, and thus can cause the oscillation frequency of an ion to shift. Both mass accuracy and resolution are commonly observed to be negatively affected by space charge effects. In extreme cases, expected ions may not be observed at all due to space charge effects.

Techniques such as Automatic gain control (AGC) and predictive AGC were developed to reduce and control the effects of space charge by regulating the on abundance contained in the ion trap. Although these techniques have been proven to work well, these techniques regulate on the precursor ion flux, limiting the sensitivity of MS/MS and $MS^n$ experiments. From the foregoing it will be appreciated that a need exists for improved systems and methods for regulating the ion population in an ion trap for maximum sensitivity for $MS^n$ analysis.

SUMMARY

In a first aspect, a mass spectrometry apparatus can include an ion source, an ion trap and a mass spectrometer controller. The ion source can be configured to generating ions. The ion trap can be configured to trap ions within a RF field; eject unwanted ion while retaining target ions; and fragment target ions. The mass spectrometer controller can be configured to determine an injection time for the ion trap based on a precursor ion flux and a product ion flux; fill the ion trap with ions from the ion source for an amount of time equal to the injection time; isolate target precursor ions in the ion trap; fragment the target precursor ions to generate product ions; and mass analyzing the product ions.

In embodiments of the first aspect, the mass spectrometry controller can be further configured to perform a scan cycle without fragmentation to determine the precursor ion flux.

In embodiments of the first aspect, the mass spectrometry controller can be further configured to perform a scan cycle with fragmentation to determine the product ion flux.

In embodiments of the first aspect, the injection time can be further based on a maximum injection time.

In embodiments of the first aspect, the injection time can be calculated to keep the number of precursor ions below an isolation space charge limit, an activation space charge limit, or any combination thereof, and to keep the number of product ions below a spectral space charge limit. In particular embodiments, the injection time can be long enough for the precursor ions to exceed the spectral space charge limit.

In embodiments of the first aspect, the mass spectrometer controller can be further configured to isolate ion fragments and fragment the isolated ion fragments to generate product ions.

In a second aspect, a method of analyzing ion fragments can include determining an injection time for an ion trap based on a precursor ion flux and a product ion flux; supplying ions to an ion trap for an amount of time equal to the injection time; isolating target precursor ions in the ion trap; fragmenting the target precursor ions in the ion trap to generate product ions; and mass analyzing the product ions.

In embodiments of the second aspect, fragmenting the target precursor ions further can include isolating ion fragments and further fragmenting the isolated ion fragments to generate product ions.

In embodiments of the second aspect, the method can further include performing a scan cycle without fragmentation to determine the precursor ion flux.

In embodiments of the second aspect, the method can further include performing a scan cycle with fragmentation to determine the product ion flux.

In embodiments of the second aspect, the injection time can be further based on a maximum injection time.

In embodiments of the second aspect, the injection time can be calculated to keep the precursor ions below an isolation space charge limit, an activation space charge limit, or any combination thereof, and to keep the product ions below a spectral space charge limit. In particular embodiments, the injection time can be long enough for the precursor ions to exceed the spectral space charge limit.

In a third aspect, a non-transitory computer readable medium can include instructions that when implemented by a processor perform the steps of determining an injection time for an ion trap based on a precursor ion flux and a product ion flux; filling the ion trap for an amount of time equal to the injection time; isolating target precursor ions in the ion trap; fragmenting the target precursor ions in the ion trap to generate product ions; and mass analyzing the product ions.

In embodiments of the third aspect, the non-transitory computer readable medium can further include instructions for performing a scan cycle without fragmentation to determine the precursor ion flux.

In embodiments of the third aspect, the non-transitory computer readable medium can further include instructions for performing a scan cycle with fragmentation to determine the product ion flux.

In embodiments of the third aspect, injection time can be further based on a max injection time.

In embodiments of the third aspect, the injection time can be calculated to keep the precursor ions below an isolation space charge limit, an activation space charge limit, or any combination thereof, and to keep the product ions below a spectral space charge limit. In particular embodiments, the injection time can be long enough for the precursor ions to exceed the spectral space charge limit.

DRAWINGS

For a more complete understanding of the principles disclosed herein, and the advantages thereof, reference is now made to the following descriptions taken in conjunction with the accompanying drawings and exhibits, in which.

Figure 1:
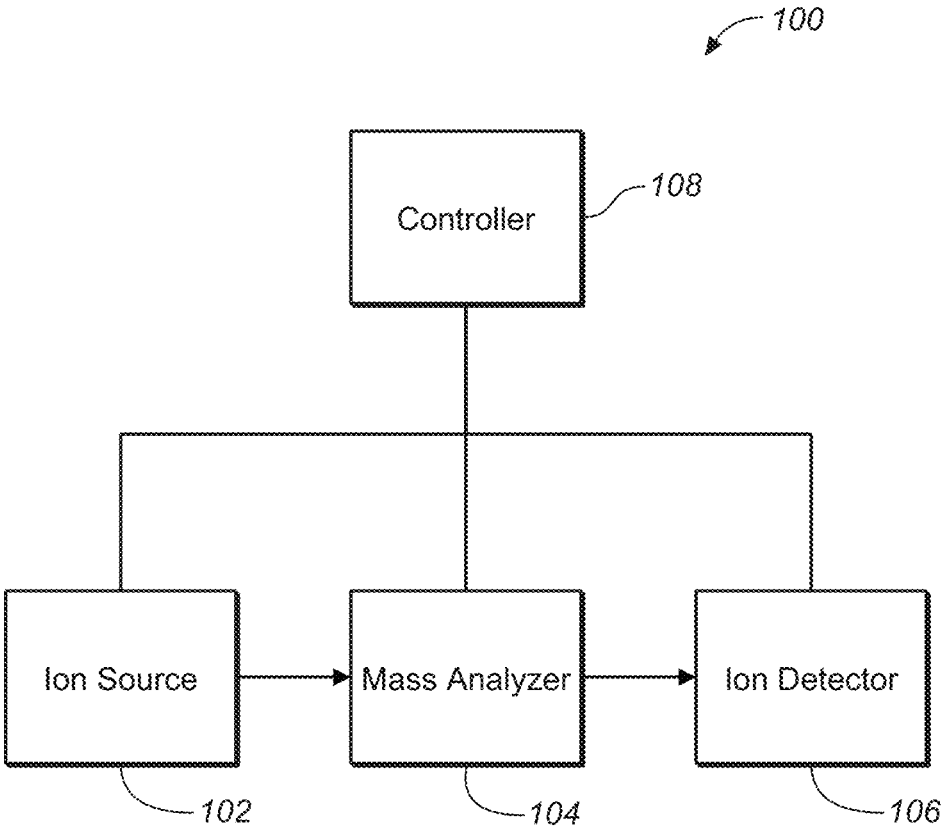
FIG. 1 is a block diagram of an exemplary mass spectrometry system, in accordance with various embodiments.

FIGS. 6A, 6B, 6B-1, 6C, and 6C-1 are graphs illustrating a MS4 analysis of cyclosporine, in accordance with various embodiments.

FIGS. 7A, 7B, 7C, and 7D are spectra illustrating an MS2 analysis of Levetiracetam, in accordance with various embodiments.

FIGS. 8A, 8B, 8C, 9A, 9B, and 9C are graphs illustrating MS3 analysis of Vancomycin, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., ORBITRAP) mass analyzer, Fourier transform ion cyclotron resonance (FT-ICR) mass analyzer, and the like. In various embodiments, including when mass analyzer 104 is an ion trap, the mass analyzer 104 can also be configured or include an additional device to fragment ions using resonance excitation or collision cell collision induced dissociation (CID), electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detect negative ions.

Ion Trap

Automatic gain control (AGC) has been used to reduce and control the effects of space charge by regulating the ion abundance contained in the ion trap (See U.S. Pat. No. 5,107,109, U.S. Pat. No. 5,572,022, U.S. Pat. No. 9,165,755 predictive AGC). In general, this process can utilize a relatively fast prescan to assess the incoming ion current which can then be used to determine an appropriate accumulation time for ions for an analytical scan. The accumulation or ionization time can be reduced when the AGC prescan returns a high ion current and can be increased when the AGC prescan returns a low ion current. Thus, the ion abundance for the analytical scan can be regulated and space charge effects can be managed to within a tolerable range.

Figure 3A:
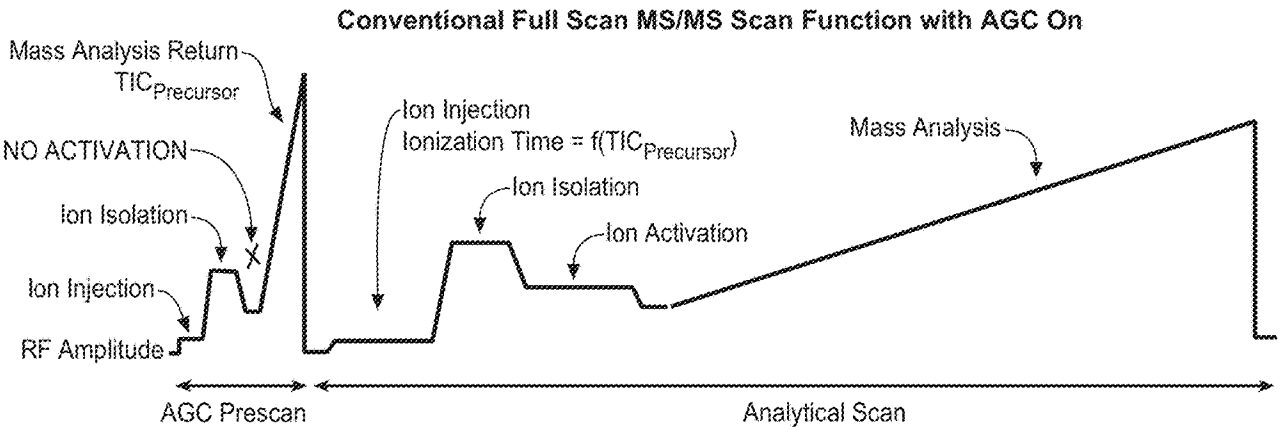
FIGS. 3A and 3B are diagrams illustrating exemplary RF Amplitude settings for MS/MS scans, in accordance with various embodiments.

The space charge effects that are of highest concern are ones that effect the fundamental quality of the mass spectra, primarily mass accuracy and resolution. This space charge limit can be referred to as the spectral space charge limit, and it can be one of the several different types of limits for ion trap operation. When doing full scan MS analysis, the AGC prescan rapidly takes a low-resolution full scan spectra with a similar mass range to the analytical scan. Thus, the full scan total ion current (TIC) can be used to regulate the appropriate accumulation time for the full scan analytical scan. For MS/MS (and $MS^n$) type scans however, typically the precursor window of interest can be isolated during the AGC prescan and so the system can regulate the accumulation time based on the isolated precursor ion flux. Typically, no activation of the precursors is performed in the prescan for determining the precursor ion flux since the total fragment ion signal cannot be larger than the precursor ion flux. (See FIG. 3A.)

In other embodiments, regulation of the precursor ions can be done without a prescan, such as when a full scan mass spectra is obtained before the $MS^n$ spectrum, for example when doing data-dependent scanning, and the ion flux of a precursor window of interest can simply be obtained from its intensity in this preceding full scan MS spectrum. When doing chromatography however, the full scan must be close in time to the MS/MS scan to work properly since the precursor intensity may significantly change with time, but this method can avoid the need to perform a prescan.

Although these techniques have been proven to work well, a significant limitation of these techniques is that they regulate on the precursor ion flu, and conversion of precursors to product ions can be quite low. For maximum sensitivity for MS/MS and $MS^n$ experiments, it can be desirable to regulate on the actual product ions. This would assure that the filling of the trap to the spectral space charge limit is with the product ions of interest. However, regulating on the product ions is not without challenges. The generation and observation of product ions can be dependent on many different things including parameters such as the effective collision energy of the fragmentation technique, the scanned mass range, and of course the characteristics of the analyte product ion of interest. As a result, there may be many potential reasons for the observed product ion intensity to be very low, or even not observed at all. This can then lead to very long accumulation times, which can slow the overall scan times way down and risks other space charge limitations coming into play, such as during ion isolation (isolation space charge limit), activation (activation space charge limit), or even surpassing the storage capacity of the trap (storage space charge limit). If the storage capacity of the trap is exceeded, ions can spill out of the trap in an m/z dependent manner.

The presence of background interfering compounds which are of the same or similar m/z as the precursor ion of interest can be another issue for doing AGC on precursor ion intensities. If the intensity of this unimportant ion is large, it can make the AGC process severely limit the accumulation time, reducing the sensitivity for mass analysis of the actual compound of interest.

Figure 2:
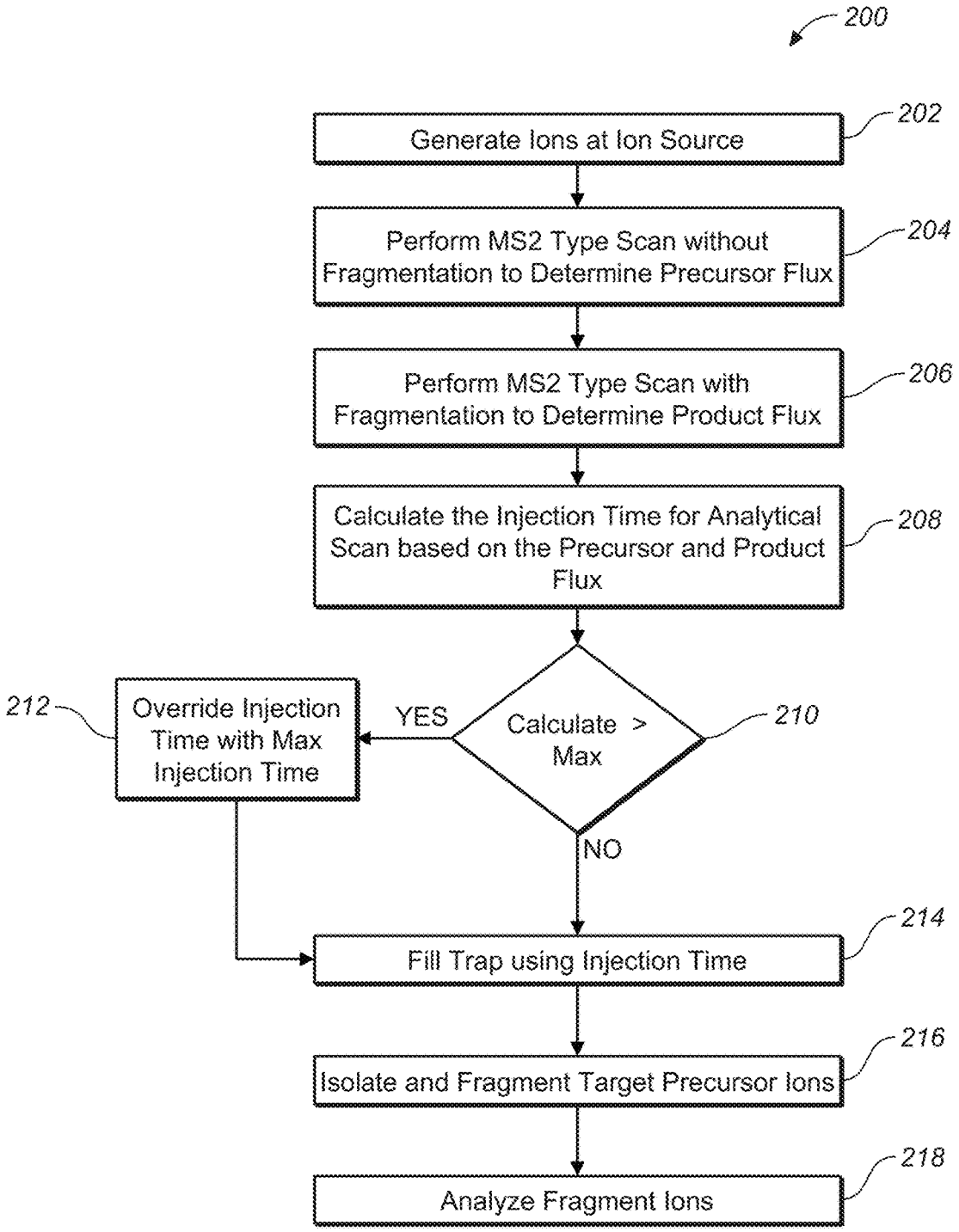
FIG. 2 is a flow diagram illustrating an exemplary method of regulating accumulation of ions in an ion trap, in accordance with various embodiments.
Figure 3B:
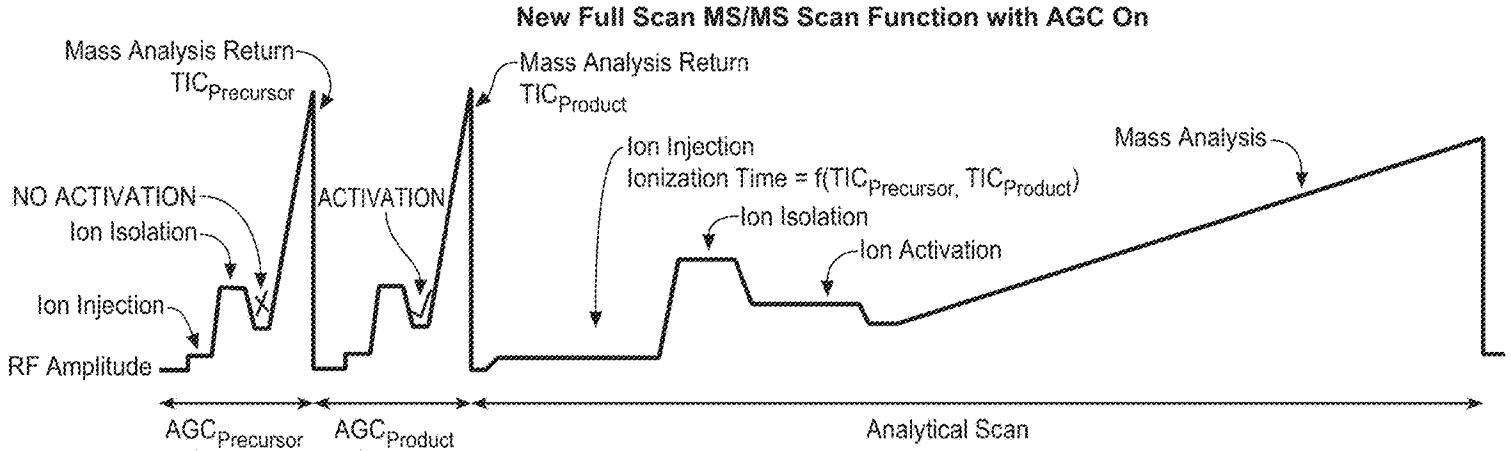

FIG. 2 is a flow diagram illustrating a method 200 of regulating the accumulation of ions in an ion trap so as to fill the ion trap with product ions, whose scan function is also illustrated in FIG. 3B. At 202, ions can be generated in an ion source. At 204, a first scan can be performed without fragmentation to determine the precursor ion flux. At 206, a second scan can be performed with fragmentation to determine the product flux. In various embodiments, the first scan and the second scan can differ only in the activation of ions within the trap, others can differ in mass analysis scan ranges also. Activation and subsequent fragmentation of the target precursor ions can be accomplished by various techniques known in the art, including resonance excitation and collision cell collision induced dissociation (CID), photo dissociation (such as UVPD), electron transfer dissociation (ETD), and the like. In various embodiments, the activation can be switched on and off by changing the amount of collision gas in an ion trap or by turning on and off an energy source such as a UV source, laser source, auxiliary RF source, or the like.

At 208, the injection time for an analytical scan can be calculated. The capacity of an ion trap is limited due to the space charge of the ions within the trap at various stages of the isolation, activation, and analysis. Based on the measured precursor flux and the measured product flux, the injection time can be determined to avoid the various space charge limits during the various stages. It can be observed that the spectral space charge limit is less than the isolation space charge limit or the activation space charge limit, both of which are less than the storage space charge limit. By exploiting the increased effective capacity of just storing ions in the ion trap, and during isolation and activation, the amount of resulting product ions can be increased versus previous techniques. In a particular embodiment, the calculated injection time can be determined according to the following equations:

$$InjectTime_{Precursor} = \frac{AGCTarget_{Precursor}}{PrescanTIC_{Precursor}} * PrescanInjectTime. \quad \text{Equation 1}$$

$$InjectTime_{Product} = \frac{AGCTarget_{Product}}{PrescanTIC_{Product}} * PrescanInjectTime. \quad \text{Equation 2}$$

$$InjectTime = \min(InjectTime_{Precursor}, InjectTime_{Product}) \quad \text{Equation 3}$$

In various embodiments, the $AGCTarget_{Product}$ can be set at or below the spectral space charge limit of the ion trap, while the $AGCTarget_{Precursor}$ can be set at or below the isolation space charge limit and the activation space charge limit but close to or above the spectral space charge limit. Regulating the analytical scans ionization/accumulation time according to both the product ion flux, along with the precursor ion flux, instead of just the precursor ion flux only can exploit the fact that the ion trap can be filled with ~100× more precursor ions than is conventionally used prior to the fragmentation and mass analysis, which, in turn, can then provide up to ~100× higher sensitivity for product ions.

At 210, it can be determined if the calculated injection time is greater than some specified maximum injection time. The maximum injection time can be provided by the user or determined based on other limits, such as the width of a chromatographic peak or a required number of scans per time unit. In other situations, such as during a constant infusion of sample or in paperspray experiments where the scan time (and thus the injection time) is not limited, longer injection times can provide sufficient precursor ions to conduct MS/MS and MS″ of lower abundance ions where there may not otherwise be sufficient ions without these techniques.

When the calculated injection time exceeds the maximum injection time, the injection time can be set to the maximum injection time, as illustrated at 212.

At 214, the injection time can be set to the maximum injection time or the calculated injection time and the ion trap can be filled for a duration equal to the injection time. At 216, the target precursor ions can be isolated and subsequently fragmented, and at 218, the product or fragment ions can be analyzed.

Since this technique can allow the injection times to be quite long, this method may be more useful in situations where time is not restricted, such as when doing infusion or using paperspray ionization. In such situations, more elaborate AGC techniques to achieve high sensitivity MS″ can be considered. For example, using several intelligent AGC prescans can be implemented to assure maximum sensitivity and linear dynamic range for MS″.

In various embodiments, an MS type prescan to assess the relative abundance of a precursor ion of interest can be followed by an MS2 type prescan using an injection time based on the first prescan to assess the fragmentation efficiency of a precursor to product ions. The prescans can be followed by estimating an optimum injection time for the MS2 scan, checking if using that injection time gives a linear response, and adjusting the injection time if the estimated optimum injection time does not provide a linear response. The resulting injection time can be utilized for all subsequent scans to provide both increased sensitivity and a linear response.

Computer-Implemented System

Figure 4:
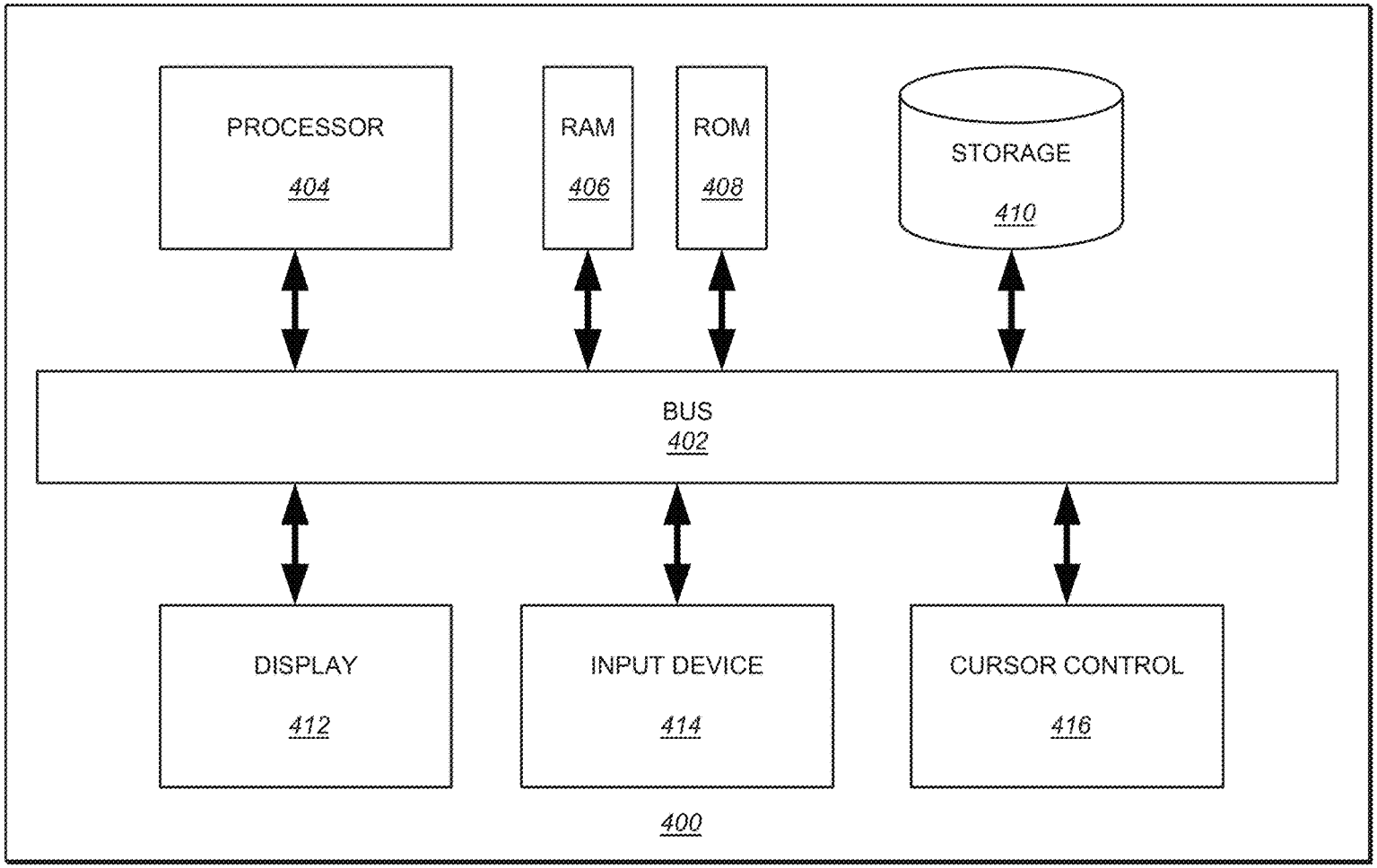
FIG. 4 is a block diagram illustrating an exemplary computer system.

FIG. 4 is a block diagram that illustrates a computer system 400, upon which embodiments of the present teachings may be implemented as which may incorporate or communicate with a system controller, for example controller 48 shown in FIG. 1, such that the operation of components of the associated mass spectrometer may be adjusted in accordance with calculations or determinations made by computer system 400. In various embodiments, computer system 400 can include a bus 402 or other communication mechanism for communicating information, and a processor 404 coupled with bus 402 for processing information. In various embodiments, computer system 400 can also include a memory 406, which can be a random access memory (RAM) or other dynamic storage device, coupled to bus 402, and instructions to be executed by processor 404. Memory 406 also can be used for storing temporary variables or other intermediate information during execution of instructions to be executed by processor 404. In various embodiments, computer system 400 can further include a read only memory (ROM) 408 or other static storage device coupled to bus 402 for storing static information and instructions for processor 404. A storage device 410, such as a magnetic disk or optical disk, can be provided and coupled to bus 402 for storing information and instructions.

In various embodiments, computer system 400 can be coupled via bus 402 to a display 412, such as a cathode ray tube (CRT) or liquid crystal display (LCD), for displaying information to a computer user. An input device 414, including alphanumeric and other keys, can be coupled to bus 402 for communicating information and command selections to processor 404. Another type of user input device is a cursor control 416, such as a mouse, a trackball or cursor direction keys for communicating direction information and command selections to processor 404 and for controlling cursor movement on display 412. This input device typically has two degrees of freedom in two axes, a first axis (i.e., x) and a second axis (i.e., y), that allows the device to specify positions in a plane.

A computer system 400 can perform the present teachings. Consistent with certain implementations of the present teachings, results can be provided by computer system 400 in response to processor 404 executing one or more sequences of one or more instructions contained in memory 406. Such instructions can be read into memory 406 from another computer-readable medium, such as storage device 410. Execution of the sequences of instructions contained in memory 406 can cause processor 404 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 404 for execution. Such a medium can take many forms, including but not limited to, non-volatile media, volatile media, and transmission media. Examples of non-volatile media can include, but are not limited to, optical or magnetic disks, such as storage device 410. Examples of volatile media can include, but are not limited to, dynamic memory, such as memory 406. Examples of transmission media can include, but are not limited to, coaxial cables, copper wire, and fiber optics, including the wires that comprise bus 402.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages and on conventional computer or embedded digital systems.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Results

A full characterization of the space charge limits for storage, isolation, and activation is done using an example target compound such as cyclosporine D. Having understood the linear ranges of each, the order of each of the space charge limits is determined. In general, the spectral space charge limit<isolation space charge limit<activation space charge limit<storage space charge limit. The measured values for the storage and spectral limits for a particular implementation of a linear and 3D ion traps are shown and compared in Table 1 and indicate their difference by 3 orders of magnitude in both cases, with the isolation and activation values being in between (not shown since there is dependence on the exact method for performing these steps). It is clear that the ion trap can be filled with much higher numbers of ions than the spectral space charge limit. As long as the isolation and activation steps reduce the ion abundance to be equal to or less than the spectral limit, the data will be valid, and can therefore contain many more product ions than would otherwise be available.

TABLE 1

Measured values of the Storage and Spectral Space Charge Limits for the Linear and 3D Traps.

| | 2D-LTQ | 3D-LCQ |
|---|---|---|
| Storage Space Charge Limit: | ~$3 \times 10^7$ | ~$1.5 \times 10^6$ |
| Spectral Space Charge Limit: | ~$3 \times 10^4$ | ~$1.5 \times 10^3$ |
| Typical AGC Target: | ~$1 \times 10^4$ | ~$5 \times 10^2$ |

Figure 5:
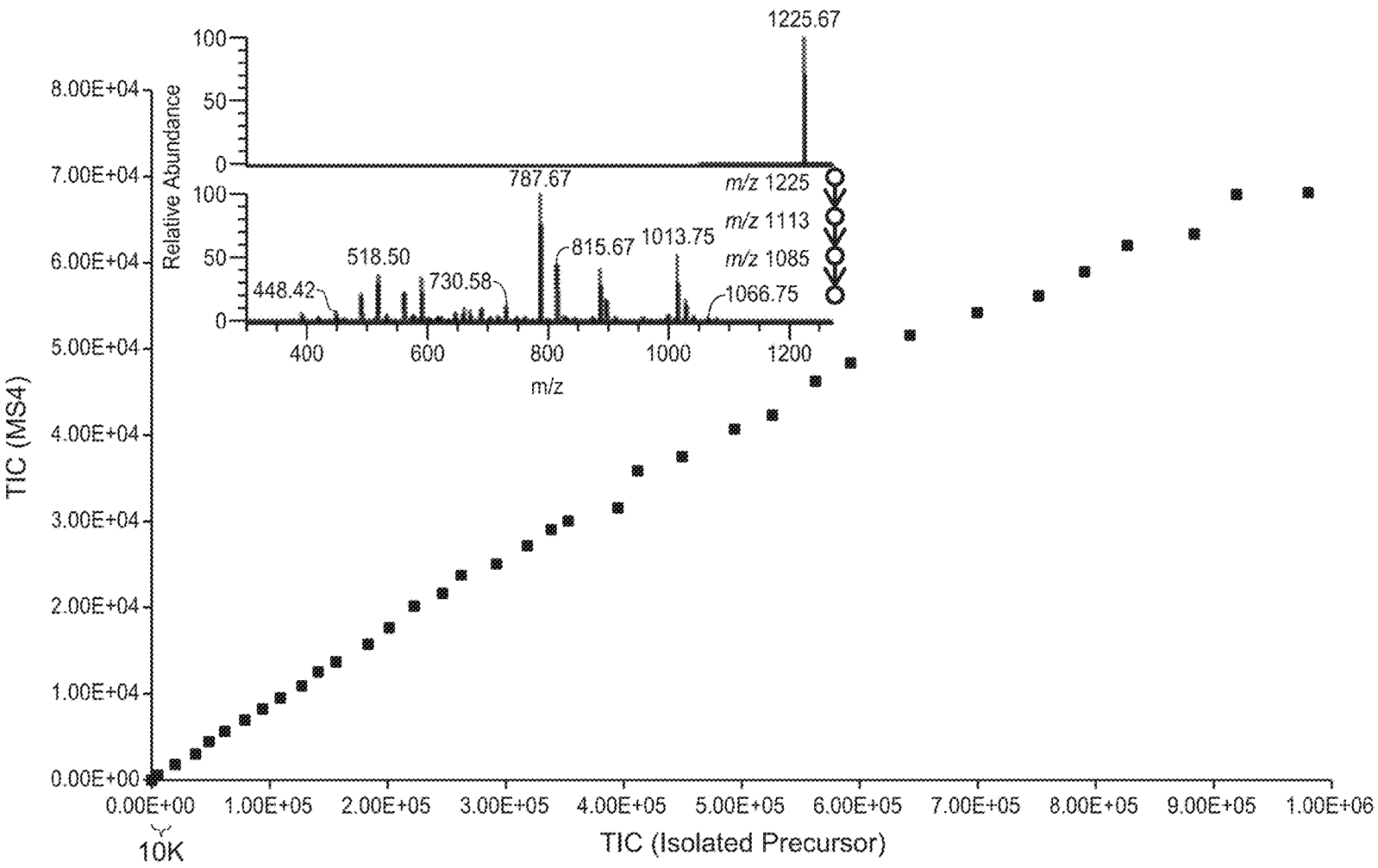
FIG. 5 is a graph illustrating the linearity of the TIC of the MS4 product ions versus the TIC of the Precursor, in accordance with various embodiments.

FIG. 5 shows the analysis of a solution of 100 ng/ml of Cyclosporin and is infused to the Thermo EASY-SPRAY Nano ESI source at a rate of 0.35 ul/min with a spray voltage=+2 kV.

FIG. 5 shows good linearity of the total $MS^4$ product ion count, TIC ($MS^4$), versus the total ion count of the precursor ions, TIC (Isolated Precursor), even well beyond the spectral space charge limits of 3E4. The data shows that the single step of isolation of the precursor range of interest is predominantly linear with respect to the generation of MS4 product ions, even up to 10E6 ions. This linear relationship supports that the trap can be filled with MS4 ions and still maintain the linear relationship with injection time and therefore be quantitative. The isolation window width is set to be 5 amu for this example.

Figure 6A:
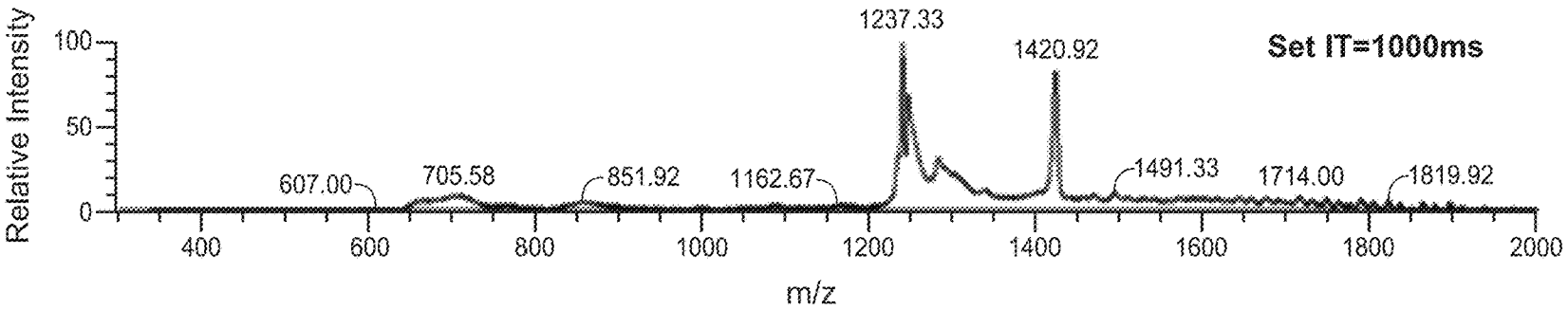
Figure 6B:
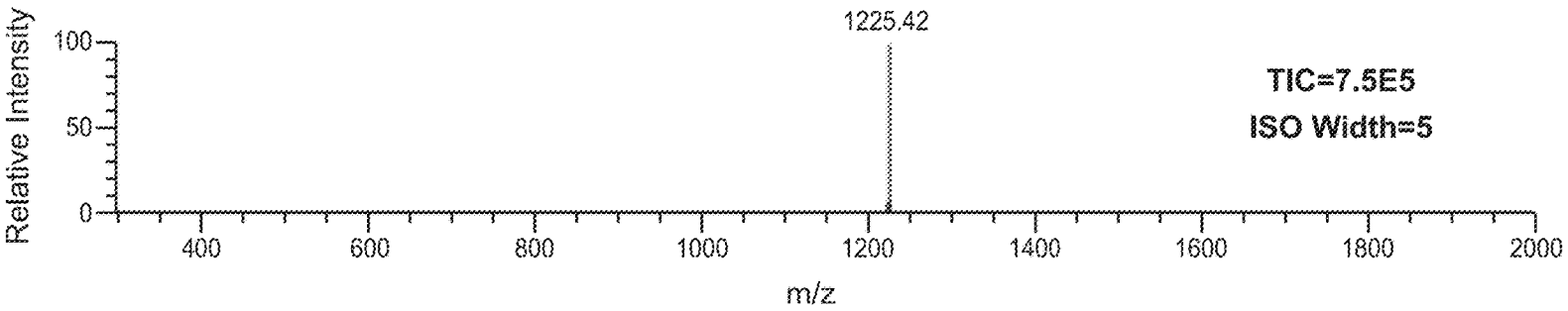
Figures 1, 6B:
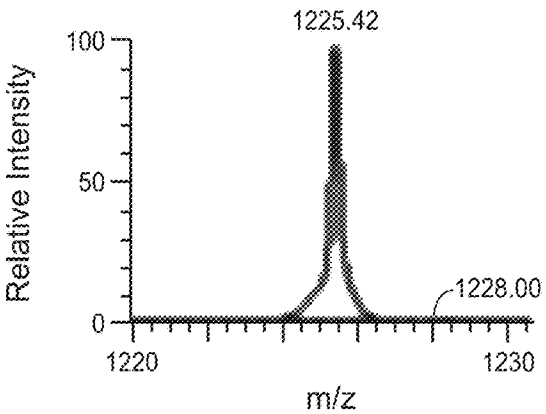
Figure 6C:
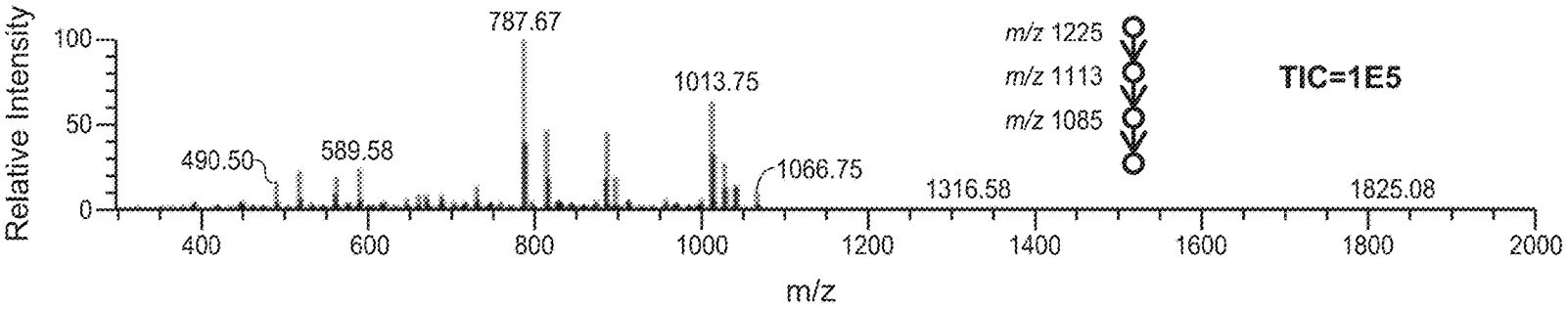
Figures 1, 6C:
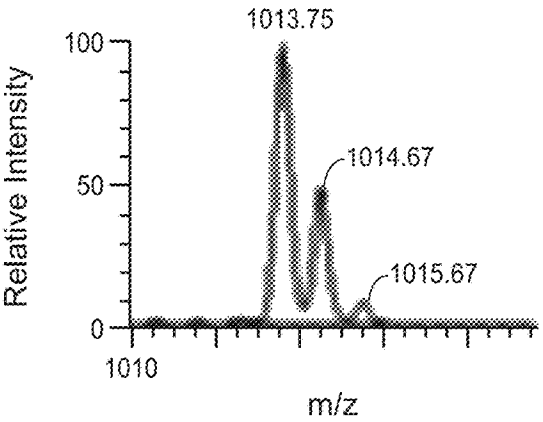

FIGS. 6A, 6B, and 6C show a MS4 mass analysis of cyclosporin $[M+Na]^+$ with $AGCTARGET_{Precursor}$ of 1E6 and $AGCTARGET_{Product}$ of 1E5. By using the scan function shown in 3B with $AGCTARGET_{Precursor}$ set to 1E6 and $AGCTARGET_{Product}$ set to 1E5, an injection time of 1000 ms is used for the analytical scan. The ion trap is filled up with millions of ions across the whole mass range as shown in FIG. 6A (severely space charged spectrum). However, when performing waveform isolation (during injection and isolation steps), the precursor ions of 1225, 1226, and 1227 (sodium adducts) can be isolated from the background as shown in the 6B. Since the total ion count (TIC) is 7.5E5 which are high enough to exceed the spectral space charge limit, the isotopes are not observed in the spectra. However, after the multiple stages of isolation and fragmentation of the selected precursor ions, the MS4 product spectra is obtained with a TIC of 1E5, which is the $AGCTARGET_{Product}$ used, and therefore shows no space charge effects, as shown in FIG. 6C.

The spectrum shown in FIG. 6C contains ~100× more ions compared to the conventional method of AGC with an $MS^n$ AGCTARGET of 1E4 and therefore demonstrates the significant improvement in sensitivity for $MS^n$ experiments.

Figure 7A:
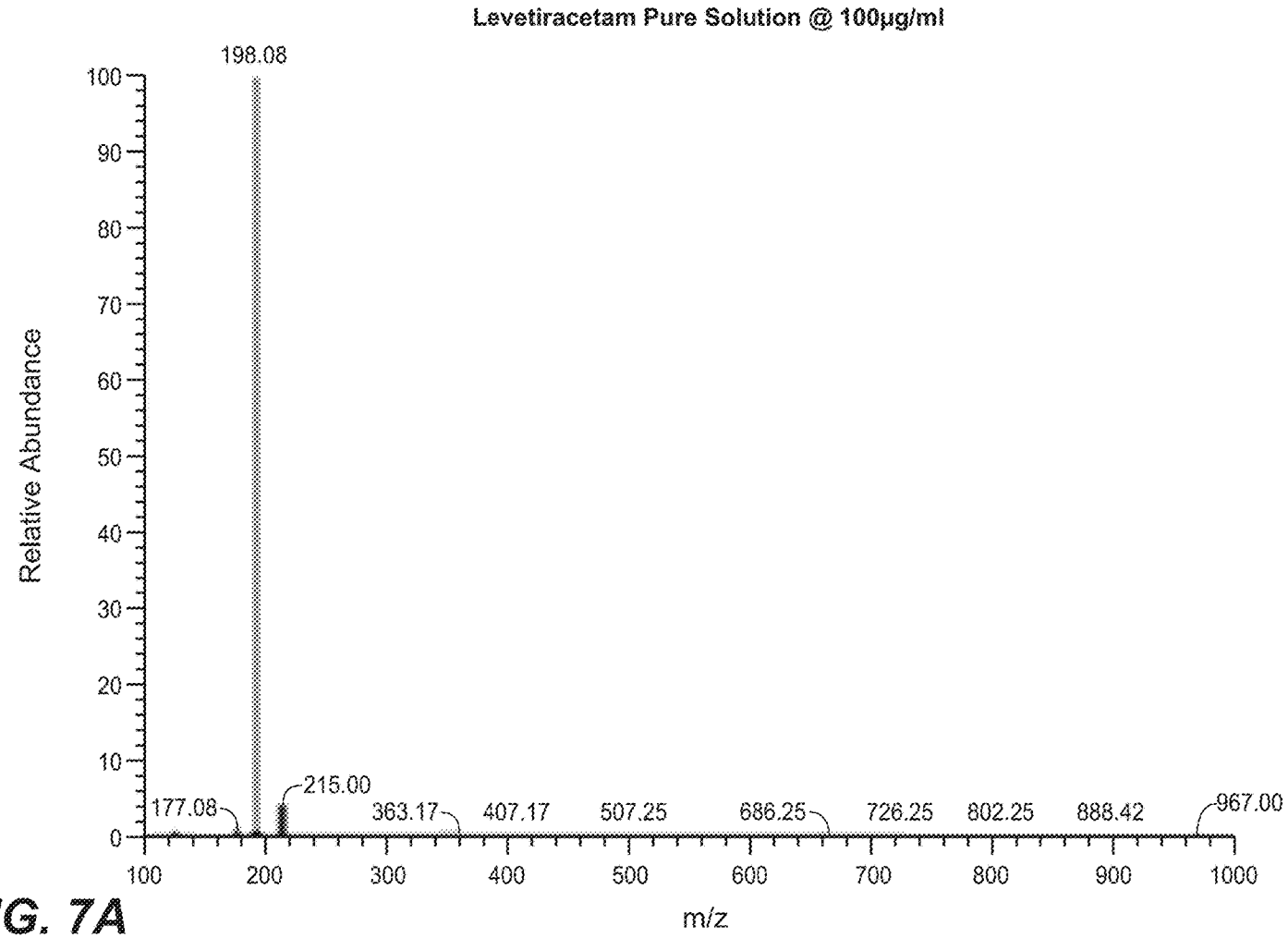

FIGS. 7A, 7B, 7C, and 7D show a MS2 analysis of Levetiracetam $[M+Na]^+$. The liquid sample is infused to the Thermo EASY-SPRAY Nano ESI source at a rate of 0.35 ul/min. Spray voltage=+2 kV. FIG. 7A shows a full MS spectrum of Levetiracetam at 100 ug/ml in pure solution.

Figure 7B:
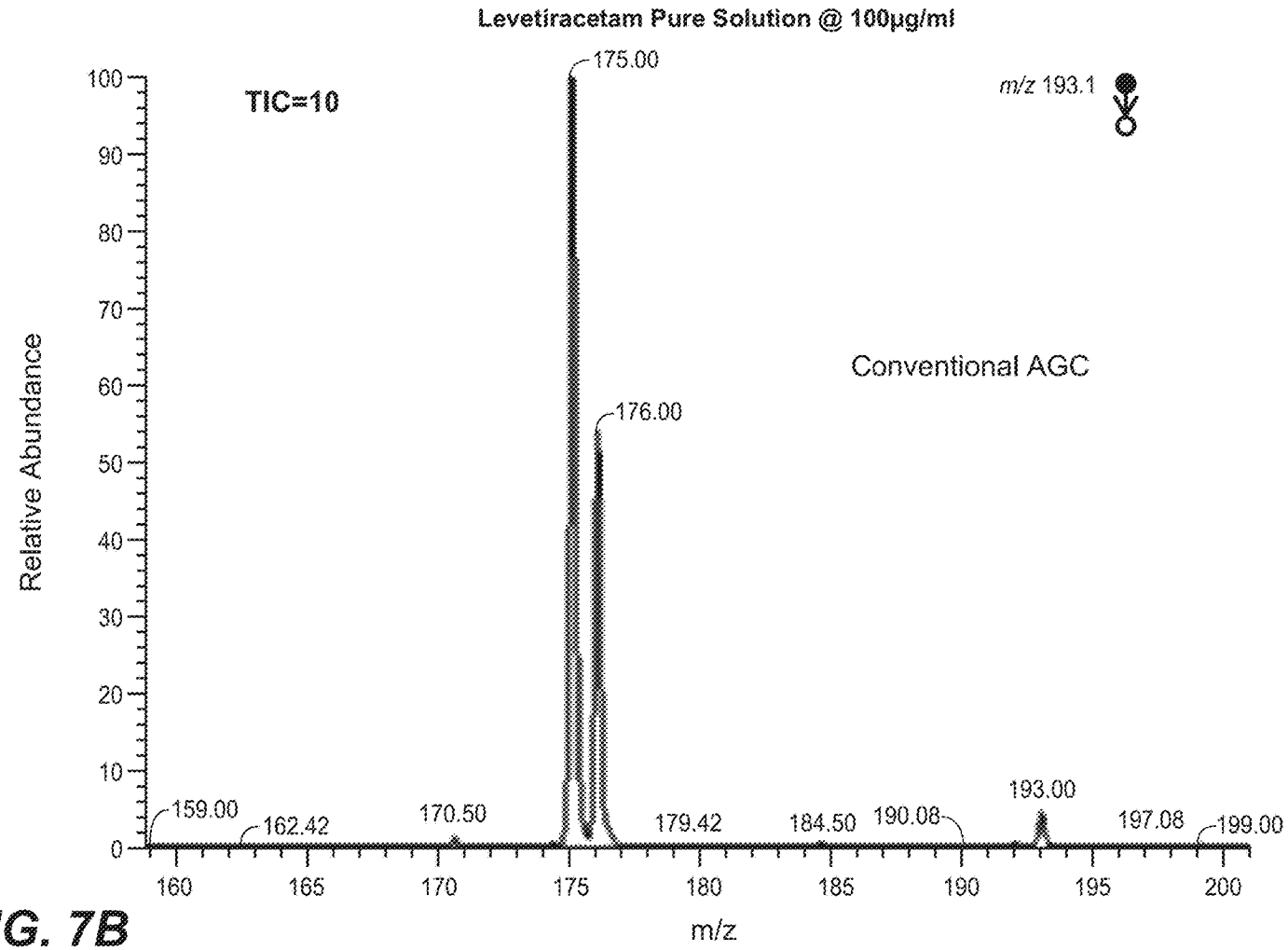
Figure 7C:
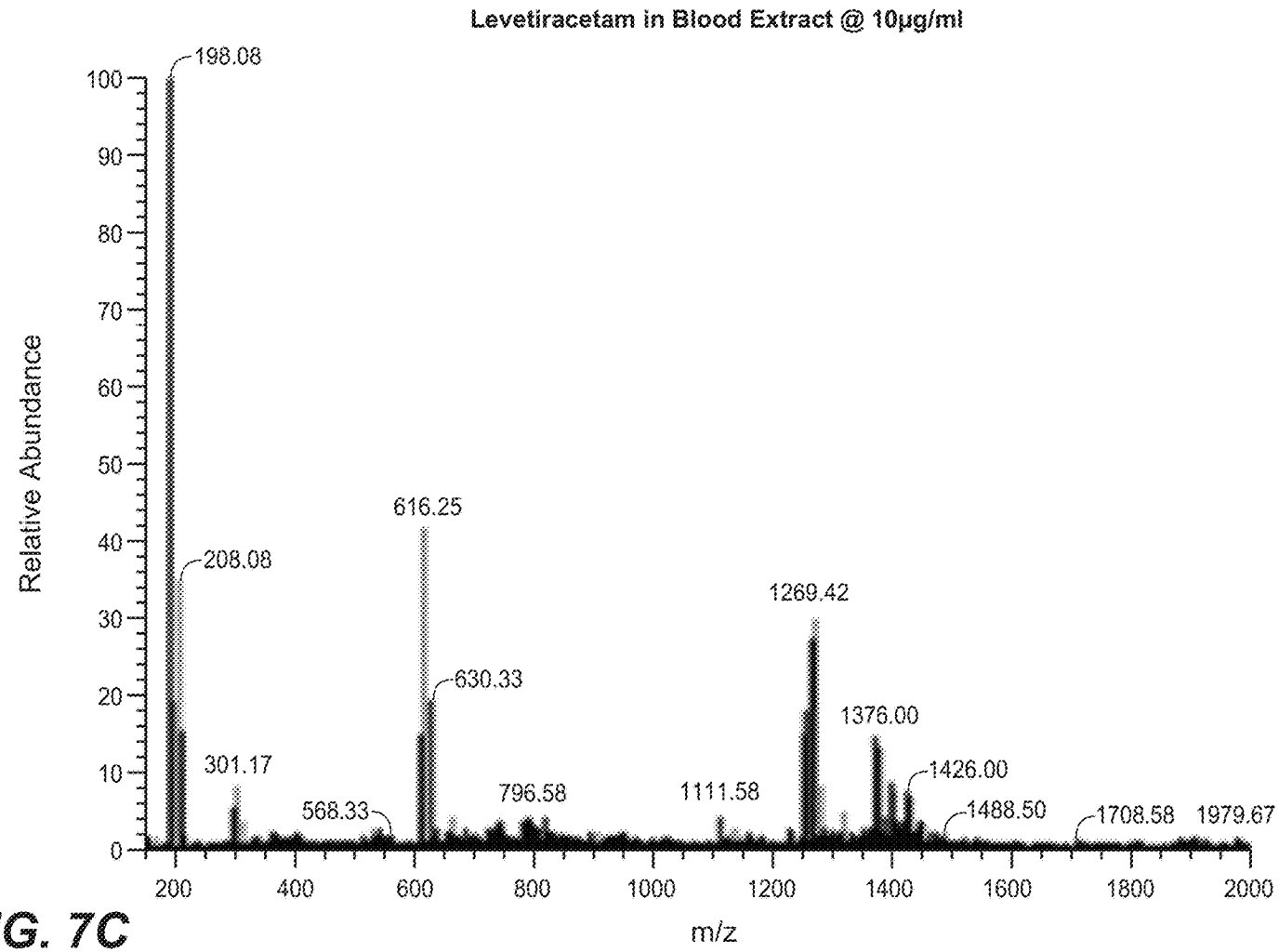
Figure 7D:
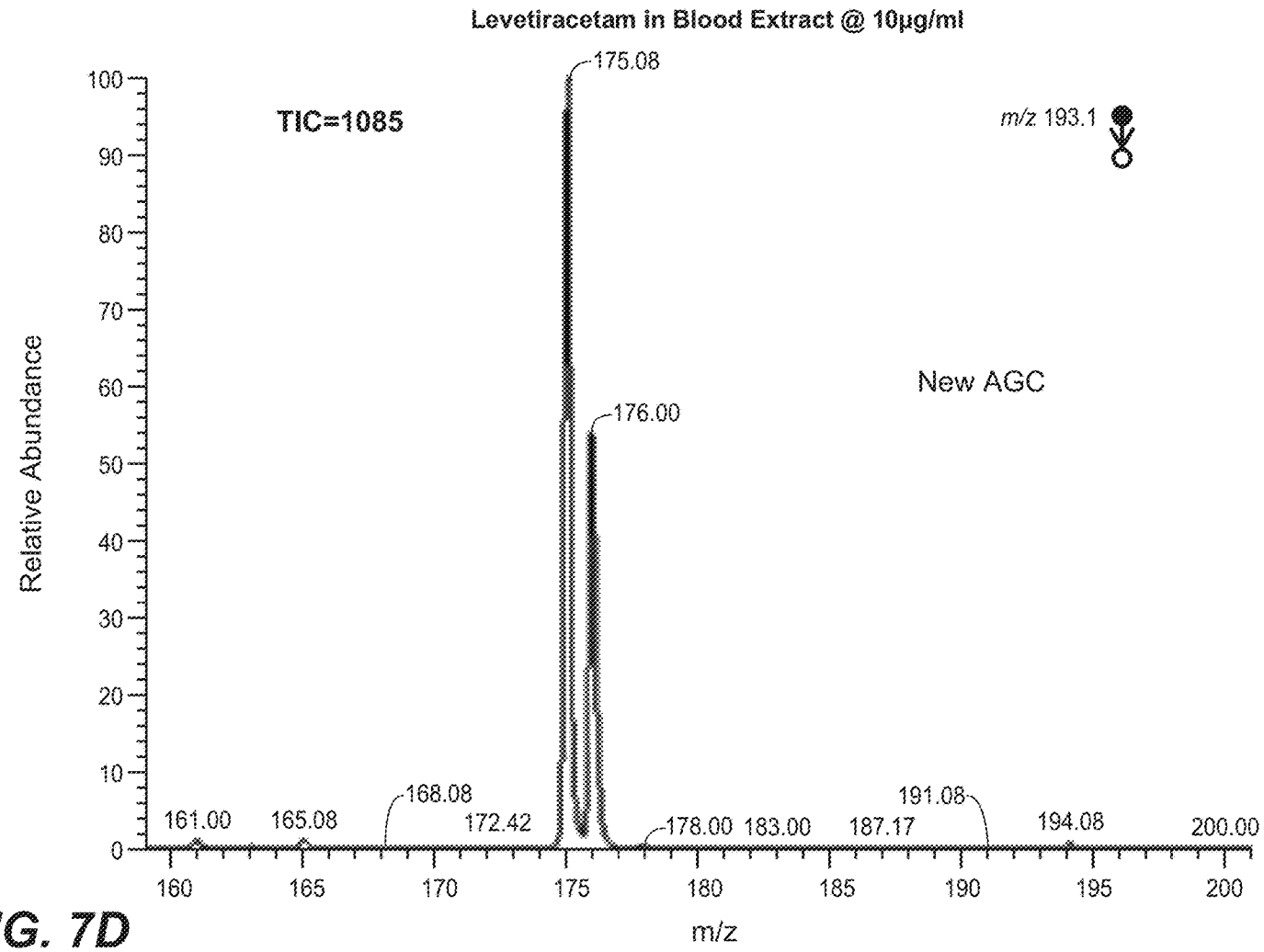

FIG. 7B shows a MS2 spectrum with conventional AGC scan function with AGCTARGET of 1E4. FIG. 7C shows a full spectrum of Levetiracetam of 10 ug/ml in blood extract which has significant amount of background ions. FIG. 7D shows a MS2 spectrum with a conventional AGC scan function with an $AGCTARGET_{Precursor}$ of 5E5 and $AGCTARGET_{Product}$ of 1E4.

The full scan spectrum of Levetiracetam FIG. 7A, shows a very strong signal of the sodium adduct precursor ion. However, because the efficiency of fragmenting the precursor ion to detectable product ions is less than 1%, even with optimized CID conditions, there are only ~10 total ion counts in the MS2 spectrum obtained as shown in FIG. 7B (spectrum is averaged). By using the scan function shown in FIG. 3B with $AGCTARGET_{Precursor}$ of 5E5 and $AGCTARGET_{Product}$ of 1E4, an injection time of ~285 ms is calculated and used for the analytical scan. As shown in FIG. 7D, the MS2 spectrum of Levetiracetam is now obtained with a TIC of 1085, which is two orders of magnitude higher in sensitivity compared to the conventional AGC regulated scan, even with a lower analyte concentration and higher chemical background. Note that the TIC is less than $AGCTARGET_{Product}$ of 1E4 because the injection time is actually limited by $AGCTARGET_{Precursor}$ according to the Equations 1-3, which is 5E5 in this experiment.

Figure 8A:
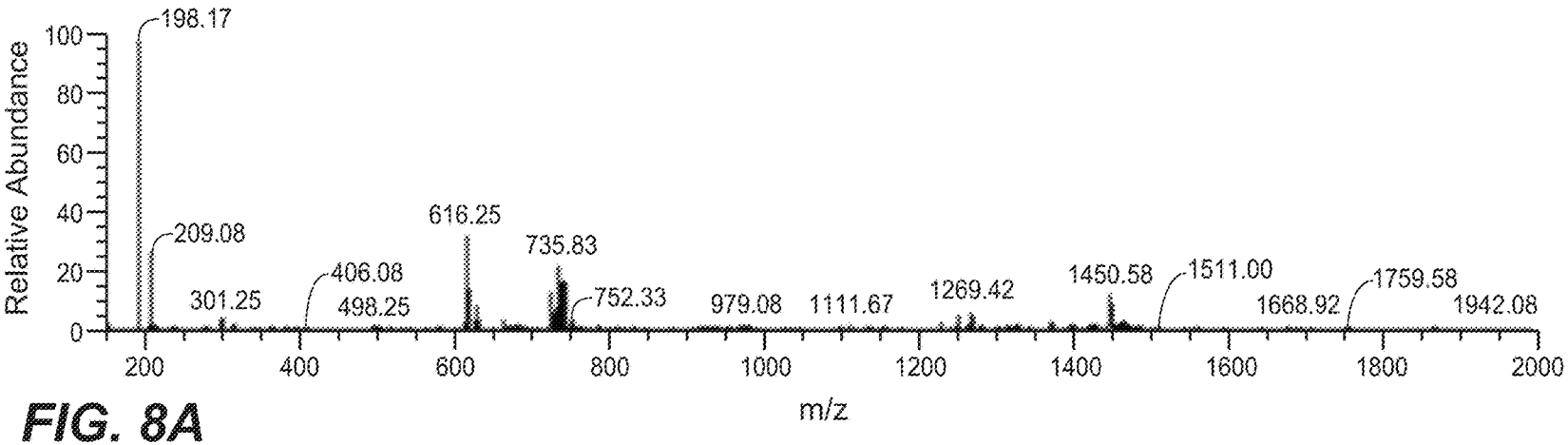
Figure 8B:
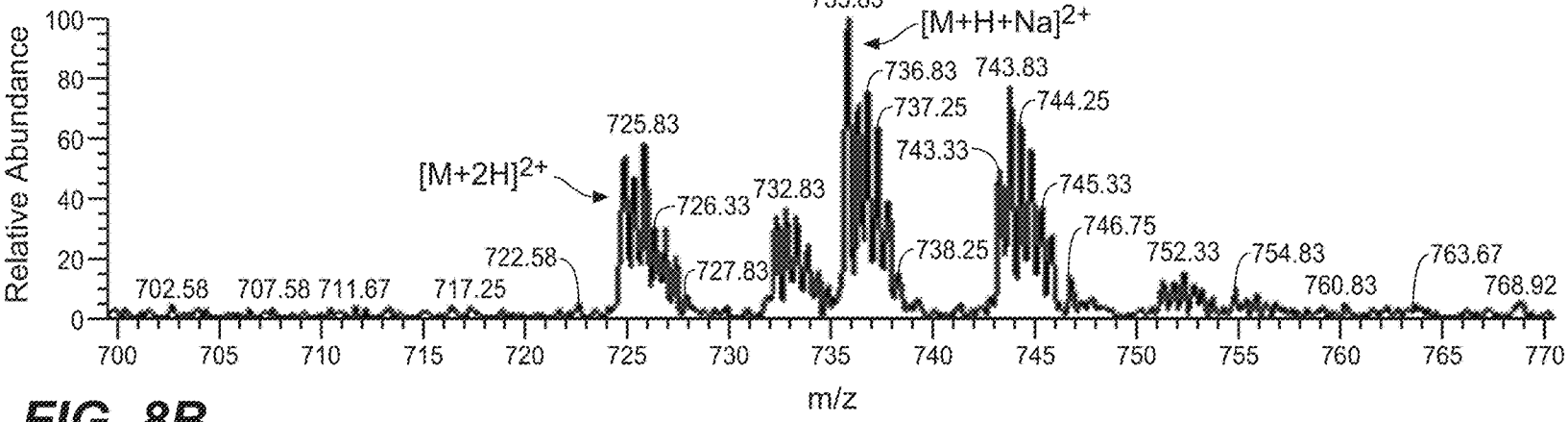
Figure 8C:
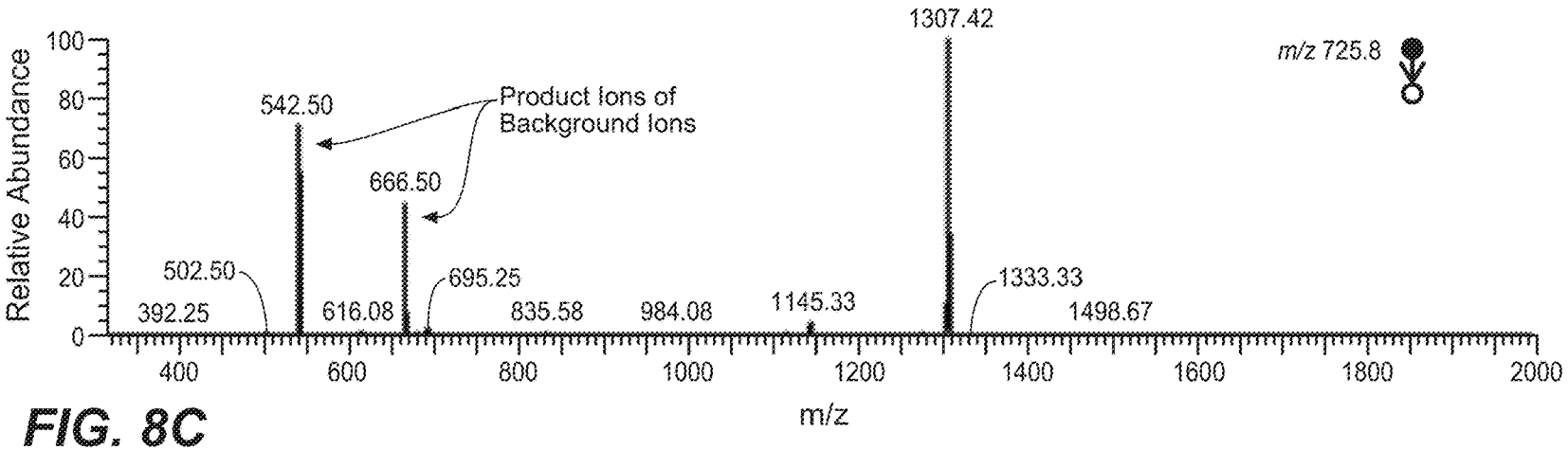

FIGS. 8A, 8B, and 8C show a mass analysis of Vancomycin in blood extract. Vancomycin is spiked into the solution at a concentration of 50 ug/ml. The liquid sample is infused to the Thermo EASY-SPRAY Nano ESI source at a rate of 0.35 ul/min. Spray voltage=+2 kV.

Figure 9A:
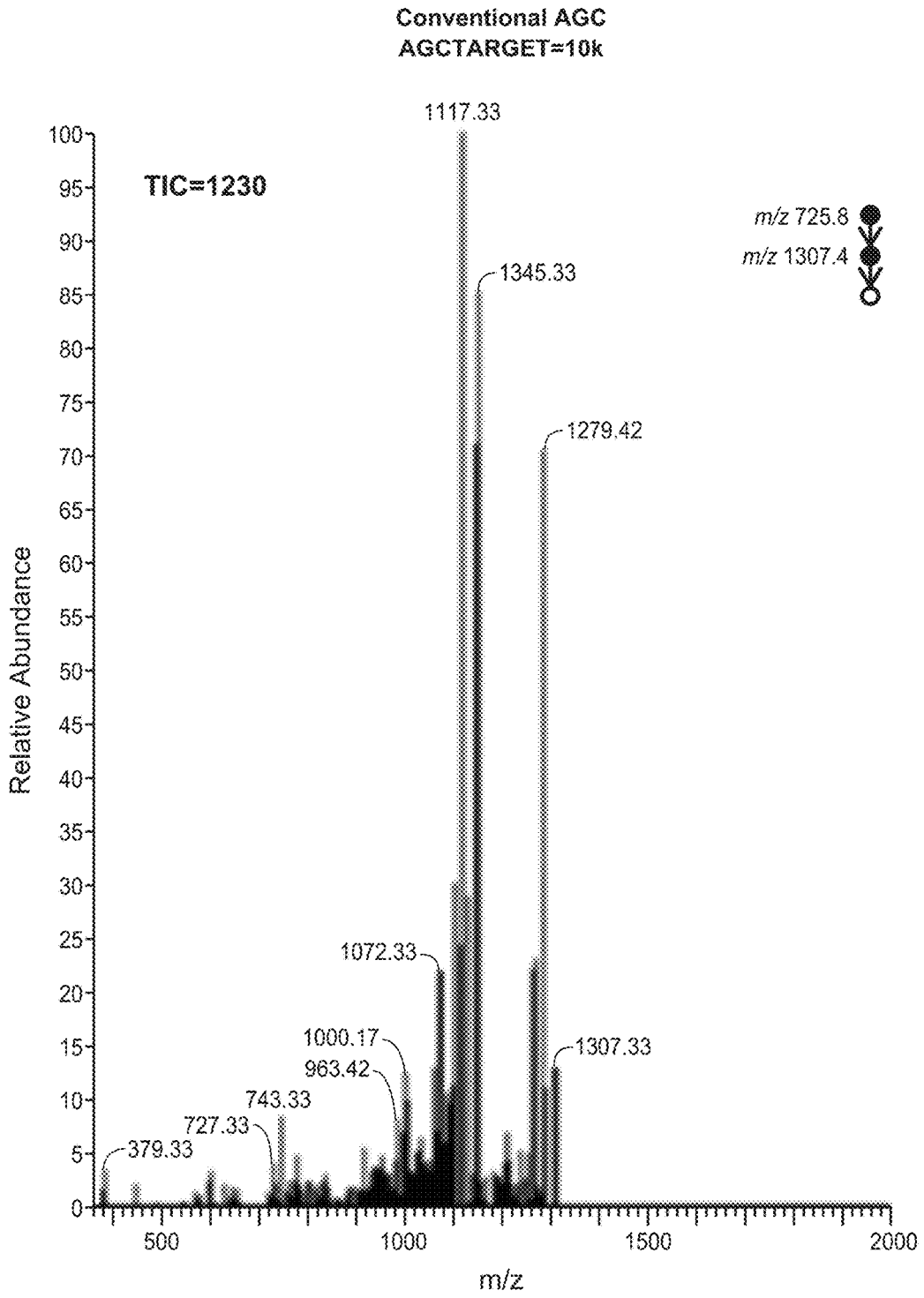
Figure 9B:
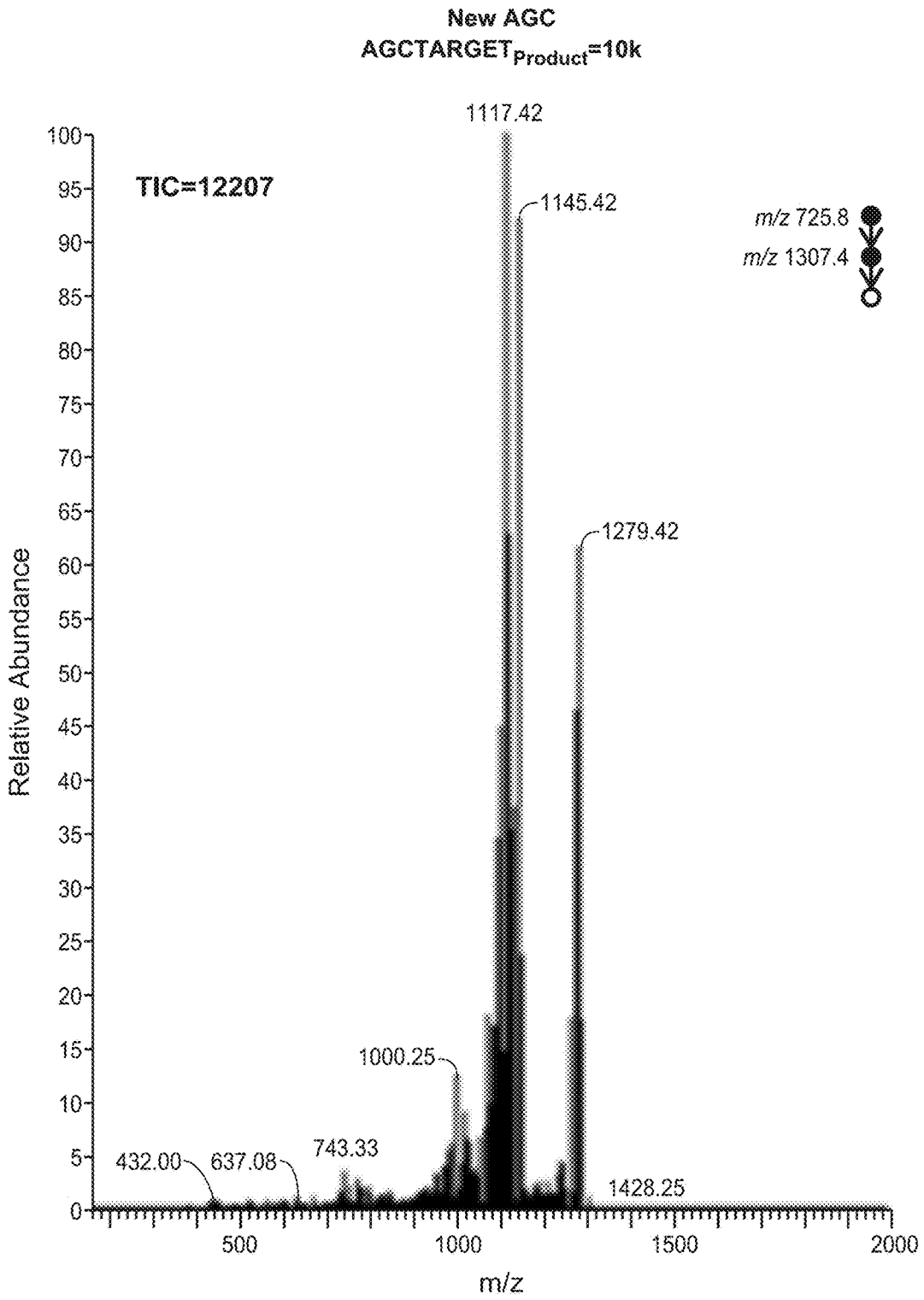
Figure 9C:
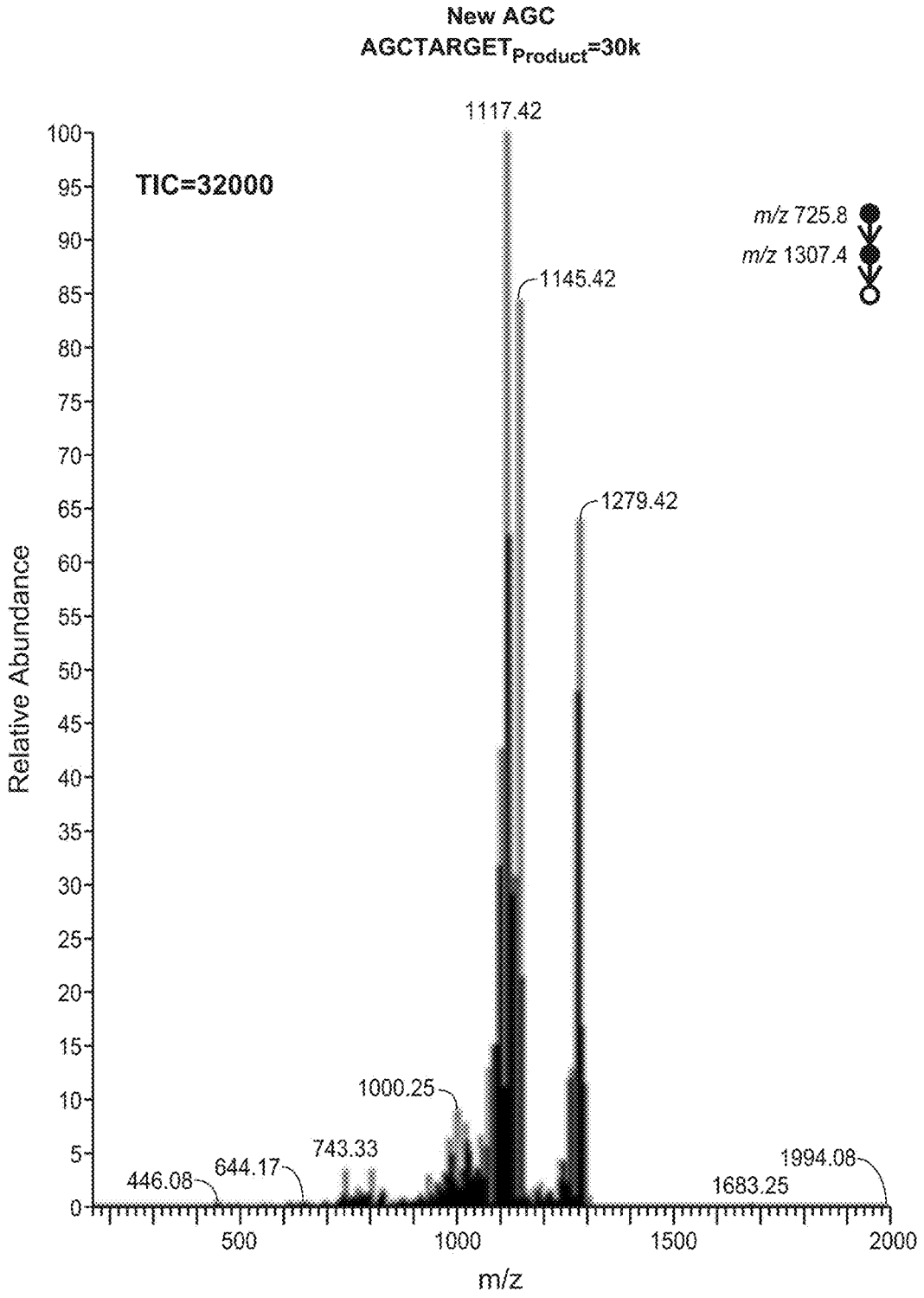

FIG. 8A shows a full spectrum of Vancomycin of 50 ug/ml in blood extract. FIG. 8B illustrates a zoomed m/z window showing doubly charged Vancomycin precursor ion clusters. FIG. 8C shows a MS2 spectrum of 725.8 doubly charged precursor ions showing the presence of interfering product ions from background. FIGS. 9A, 9B, and 9C shows a MS3 analysis of vancomycin in blood extract with (FIG. 9A) conventional AGC and (FIG. 9B) the invention described here with $AGCTARGET_{Product}$ of 1E4 and (FIG. 9C) with $AGCTARGET_{Product}$ of 3E4. The $AGCTARGET_{Precursor}$ is set to 5E5 in the scans using the invention described here (FIGS. 9B and 9C).

Besides the better sensitivity, using $MS^3$ can filter out interference from background ions near the same m/z as the precursor ions which is typically observed when directly analyzing complex samples as blood. The wider linear dynamic range demonstrated in FIG. 5 for $MS^n$ scans, suggests the opportunity for obtaining interference-free quantitative mass analysis. FIGS. 8A, 8B, and 8C show the improvements that the new AGC method described here makes to obtain stronger and cleaner signals even with high background ion interferences. As shown in 8C, the interferences from background ions are observed in the MS2 spectrum of Vancomycin. With conventional AGC methods, the presence of background ions in the precursor window could suppress the precursor ions of interest and lead to a weak $MS^n$ signal. As shown in FIG. 9A, the MS3 spectrum of vancomycin is obtained with the conventional AGC methods and AGCTARGET of 1E4. The spectrum shows a good signal to noise ratio as background ions are filtered out by performing multistage tandem mass spectrometry, but the TIC is only ~1200. With the new AGC methods described here, the signals are boosted up by ~10× and ~30× as shown in FIG. 9B and FIG. 9C with $AGCTARGET_{Product}$ of 1E4 and 3E4, respectively. Note that the TIC values in FIG. 9B and FIG. 9C are very close to the respective target values, which proves that we can fill the trap with product ions with precise control.

What is claimed is:

1. A mass spectrometry apparatus comprising:
an ion source configured to generating ions;
an ion trap configured to:
trap ions within a RF field;
eject unwanted ion while retaining target ions; and
fragment target ions;
a mass spectrometer controller configured to:
determine an injection time for the ion trap based on a precursor ion flux and a product ion flux;
fill the ion trap with ions from the ion source for an amount of time equal to the injection time;
isolate target precursor ions in the ion trap;
fragment the target precursor ions to generate product ions; and
mass analyzing the product ions.

2. The mass spectrometry system of claim 1 wherein the mass spectrometry controller is further configured to perform a scan cycle without fragmentation to determine the precursor ion flux.

3. The mass spectrometry system of claim 1 wherein the mass spectrometry controller is further configured to perform a scan cycle with fragmentation to determine the product ion flux.

4. The mass spectrometry system of claim 1 wherein the injection time is further based on a maximum injection time.

5. The mass spectrometry system of claim 1 wherein the injection time is calculated to keep the number of precursor ions below an isolation space charge limit, an activation space charge limit, or any combination thereof, and to keep the number of product ions below a spectral space charge limit.

6. The mass spectrometry system of claim 5 wherein the injection time is long enough for the precursor ions to exceed the spectral space charge limit.

7. The mass spectrometry system of claim 1 wherein to fragment the target precursor ions, the mass spectrometer controller is further configured to isolate ion fragments and fragment the isolated ion fragments to generate product ions.

8. A method of analyzing ion fragments, comprising:
determining an injection time for an ion trap based on a precursor ion flux and a product ion flux;
supplying ions to an ion trap for an amount of time equal to the injection time;
isolating target precursor ions in the ion trap;
fragmenting the target precursor ions in the ion trap to generate product ions; and
mass analyzing the product ions.

9. The method of claim 7 wherein fragmenting the target precursor ions further includes isolating ion fragments and further fragmenting the isolated ion fragments to generate product ions.

10. The method of claim 8 further comprising performing a scan cycle without fragmentation to determine the precursor ion flux.

11. The method of claim 8 further comprising performing a scan cycle with fragmentation to determine the product ion flux.

12. The method of claim 8 wherein injection time is further based on a maximum injection time.

13. The method of claim 8 wherein the injection time is calculated to keep the precursor ions below an isolation space charge limit, an activation space charge limit, or any combination thereof, and to keep the product ions below a spectral space charge limit.

14. The method of claim 13 wherein the injection time is long enough for the precursor ions to exceed the spectral space charge limit.

15. A non-transitory computer readable medium containing instructions that when implemented by a processor perform the steps of:

determining an injection time for an ion trap based on a precursor ion flux and a product ion flux;

filling the ion trap for an amount of time equal to the injection time;

isolating target precursor ions in the ion trap;

fragmenting the target precursor ions in the ion trap to generate product ions; and mass analyzing the product ions.

16. The non-transitory computer readable medium of claim 15 further comprising instructions for the step of performing a scan cycle without fragmentation to determine the precursor ion flux.

17. The non-transitory computer readable medium of claim 15 further comprising instructions for the step of performing a scan cycle with fragmentation to determine the product ion flux.

18. The non-transitory computer readable medium of claim 15 wherein injection time is further based on a max injection time.

19. The non-transitory computer readable medium of claim 15 wherein the injection time is calculated to keep the precursor ions below an isolation space charge limit, an activation space charge limit, or any combination thereof, and to keep the product ions below a spectral space charge limit.

20. The non-transitory computer readable medium of claim 19 wherein the injection time is long enough for the precursor ions to exceed the spectral space charge limit.

* * * * *